US006857816B2

(12) United States Patent
Saito et al.

(10) Patent No.: US 6,857,816 B2
(45) Date of Patent: Feb. 22, 2005

(54) ROLLER

(75) Inventors: Isao Saito, Saitama (JP); Koichi Kaneko, Saitama (JP); Yukitsugu Saba, Saitama (JP); Yasutsugu Kanamori, Saitama (JP); Hiroaki Neko, Saitama (JP)

(73) Assignee: Sakai Heavy Industries, Ltd., Tokyo (JP)

( * ) Notice: Subject to any disclaimer, the term of this patent is extended or adjusted under 35 U.S.C. 154(b) by 31 days.

(21) Appl. No.: 10/067,936

(22) Filed: Feb. 8, 2002

(65) Prior Publication Data

US 2002/0197110 A1 Dec. 26, 2002

(30) Foreign Application Priority Data

Jun. 20, 2001 (JP) ..... 2001-185705
Jul. 26, 2001 (JP) ..... 2001-226005

(51) Int. Cl.[7] ..... B62D 55/00
(52) U.S. Cl. ..... 404/128; 180/9.21
(58) Field of Search ..... 404/117, 122, 404/127, 128; 180/9.1, 9.21

(56) References Cited

U.S. PATENT DOCUMENTS 3,737,001 A * 6/1973 Rasenberger ..... 180/185
3,841,777 A * 10/1974 Domenighetti ..... 404/84.1
3,969,035 A * 7/1976 Silbernagel ..... 404/98
4,647,247 A * 3/1987 Sandstrom ..... 404/75
4,865,141 A * 9/1989 Gey ..... 180/9.26
5,009,546 A * 4/1991 Domenighetti et al. ..... 404/110
5,240,084 A * 8/1993 Christianson ..... 180/9.21
5,273,126 A * 12/1993 Reed et al. ..... 180/9.21
5,361,860 A * 11/1994 Smith et al. ..... 180/9.21
5,868,522 A * 2/1999 Campbell ..... 404/114
5,934,824 A * 8/1999 Vural ..... 404/117
5,954,148 A * 9/1999 Okumura et al. ..... 180/9.21
6,123,133 A * 9/2000 Kim et al. ..... 156/378
6,132,133 A * 10/2000 Muro et al. ..... 404/102
6,199,646 B1 * 3/2001 Tani et al. ..... 180/9.21
6,273,530 B1 * 8/2001 Johnson et al. ..... 305/116
6,334,496 B1 * 1/2002 Hiraki et al. ..... 180/9.5
6,361,435 B1 * 3/2002 Yamamoto et al. ..... 460/99
6,431,301 B1 * 8/2002 Forbes ..... 180/185
2003/0080616 A1 * 5/2003 Smith et al. ..... 305/136

FOREIGN PATENT DOCUMENTS

EP 1270823 A2 * 1/2003 ..... E02D/3/039
JP 2003-34926 A * 2/2003 ..... E02D/3/046

OTHER PUBLICATIONS

Sakai Heavy Industries, Ltd website: http://www/sakainet.co.jp/english/e_index.html (1 page—Index) and http://www.sakainet.co.jp/english/special/e_sw850.html (5 pages—Special issue sakai's super rollers for superpave mix).*

* cited by examiner

*Primary Examiner*—Gary S. Hartmann
(74) *Attorney, Agent, or Firm*—Sughrue Mion, PLLC

(57) ABSTRACT

A roller is equipped with a pair of crawlers. Each crawler includes a driving wheel detachably attached to a driving shaft. Each crawler also includes a set of driven wheels. Both sets of driven wheels are supported by a connecting member that is detachably attached on a bottom of a body. A roll, which is vibrated only in the perpendicular direction with respect to the ground surface, is attached to the body.

8 Claims, 12 Drawing Sheets

WAVE COMPOSITE OF THE ACCLERATION OF THE ROLL(FOR 0.6 SEC)

WAVE COMPOSITE OF THE ACCLERATION OF THE ROLL(FOR 0.6 SEC)

ROLLER

BACKGROUND OF THE INVENTION

1. Field of the Invention

The present invention relates to a roller with a pair of crawlers on both sides of a vehicle body. Furthermore, the present invention relates to a compaction method of the ground of the sloping ground using a roller.

2. Prior Art

As shown in FIG. 12, a vibratory roller 31, in which a vibratory roll 32 is served as the front wheel and a tire T is served as the rear wheel, is conventionally used as one of roller. The roller, such as a vibratory roller, has been used in the compaction of the not steep slope or small uneven ground.

A vibrating shaft 34, which is consists of one axis, and to which the eccentric weight 33 is fixed, is installed within the vibratory roll 32 (herein after defined as the roll). When the vibrating shaft 34 rotates, the roll 32 is vibrated by the eccentric rotation of the vibrating shaft 34, and the vibration force is applied in the 360-degree direction of the periphery of the roll 32, and thus the slope (sloping ground) is compacted.

When the compaction using the vibratory roller 31 is carried out under the disadvantageous condition, such as extremely uneven ground or the muddy land of the construction site of a highway or a dam, arid such as the sloping ground (slope), the operation of the vibratory roller 31 with stableness may be disturbed by the slipping or the sticking of the tire T in the mud. For settling these phenomenon, the applicant of the present patent application discloses the crawler-type vibratory roller for earthwork in the Japanese unexamined patent publication No. 07-3764. According to the disclosed crawler-type vibratory roller, the operation of the vehicle with stableness can be achieved even in the muddy road and the steep sloping ground and the like. The working efficiency thus can be maintained.

When detaching the crawlers from the vehicle body for repairing or replacing, however, the crawlers equipped on both sides of vehicle body are detached separately. The attaching and detaching operation of the crawler thus will be bothered. Furthermore, since the vibratory roller is frequently used in the compaction of the asphalt pavements as well as that of the embankment, it is uneconomical in the traveling efficiency to operate the vibratory roller equipped with the crawler even in the asphalt road surface by which the trafficability is stabilized.

Therefore, the roller, in which the attaching and detaching operation of the crawler is carried out with ease, and the roller which can fully demonstrates the traveling performance depending on the situation of the ground to be compacted, have been required.

In the conventional method for achieving the compaction of the sloping ground using the vibratory roller, the following difficulties have arisen. Generally, a slip of the tire will occur when the driving force at the tread exceeds the shear resistance force of the ground, and in this case the traveling condition becomes unstable.

Therefore, when the vibratory roller climbs a sloping ground, since the inclination of the vehicle body and the jumping of the roll 32, which is caused by the reaction force from the ground, are affected as the compaction progresses, the load applied to the wheel, i.e., a tire T, and the fluctuation thereof are increased. Consequently, the slip of the tire occurs via the jumping of the roll 32 and the inclination of the vehicle body, and then the vehicle body tends to become unstable.

Specifically, according to the vibratory mechanism of the roll 32, since the vibration force is applied to the roll 32 along the 360-degree direction of the periphery by the rotation of the eccentric weight 33, the roll 32 is vibrated.

The measurement value of the wave profile in the ups-and-downs and front-and-rear directions to the vehicle of the vibration acceleration, which is applied to the roll 32, is shown in FIG. 13A. The wave composite of the vibration acceleration is shown in FIG. 13B. As can be seen from FIG. 13D, the wave composite of the vibration acceleration is displacing and rotating along the ellipse-shaped locus centering on the axial center of the roll 32. According to this wave composite, since the reaction force is applied in all directions from the cross direction to the perpendicular direction at the tread, the vehicle body inclining at the sloping ground tends to become unstable.

When the component in the front-and-rear directions of the vibration force of the roll 32 is slightly deviated from the center (center of gravity) in the longitudinal direction of the vibratory roller 31, the vibration force is given to the vibratory roller 31 as a moment. Thus, the steering of the vibratory roller 31 becomes difficult.

The degree of the unstableness of the roll 32 is further increased by the slight unbalance of the weight in the longitudinal direction of the roll 32, the slight difference in the rigidity of vibration proof rubbers of left side and right side (not shown) between which the roll 32 is supported, and the difference of the reaction force from the ground which is affected by the soil and the shape of the ground. As a result of these unstableness, the jumping of the roll 32 will be promoted.

In the compaction of the sloping ground, particularly, since the direction of the center of gravity of the vehicle body (the gravity direction) is not perpendicular with respect to the slope surface, when the load fluctuation to the tire T and the slip phenomenon of the tire T are coupled thereto, the degree of the unstableness of the vehicle body is increased. Thus, the operationablity of the steering wheel becomes difficult and then the keeping of the attitude of the vehicle body becomes difficult.

Therefore, there has been required that the vibratory roller, which can compact the ground on stabilizing the vehicle body even in tie steep sloping ground, and the compaction method of the sloping ground using the vibratory roller.

SUMMARY OF THE INVENTION

The present invention is originated for attaining these requirements, and objects to supplying rollers, such as vibratory rollers, as follows. 1) a roller which can fully demonstrates the traveling performance depending on the condition of the ground to be compacted. 2) a roller in which the attaching and detaching operation is carried out with ease. 3) a roller which can compact the ground on stabilizing the vehicle body even in the steep sloping ground. Furthermore, the present invention objects to supplying the compaction method of the sloping ground using the roller, such as vibratory roller.

For attaining these requirements, there is provided a roller equipped with a left-side crawler and a right-side crawler. Each crawler includes a driving wheel detachably attached to a driving shaft of the roller. Each crawler also includes a set of driven wheels attached to a bottom of the roller body through a connecting member that is detachably attached on a bottom of the roller body. According to this roller, the efficiency of the attaching and detaching operation of the crawler is improved.

In the roller, preferably, the crawlers are replaceable with a pair of tires, and each of said tires being detachable from a driving shaft. According to this roller, the traveling performance can fully be demonstrated by replacing the crawler with the tire mutually depending on the condition of the ground to be compacted.

In the present invention, furthermore, there is provided a roller, wherein said roller is a vibratory roller in which a vibratory roll is connected to the body in an articulating manner, and wherein said driving shaft is positioned above a rotating shaft of the vibratory roll so that the body inclines with respect to the horizontal plane. According to this roller, the degree of the inclination angle of the body at the time of compaction on the sloping ground can be smaller, and the degree of the mental pressure which is brought to the operator himself by the inclination of the vehicle body is alleviated.

The roller, preferably, further comprises a roll having a perpendicularly vibratory mechanism, which vibrates the roll only in the perpendicular direction with respect to the ground surface.

In the present invention, there is provided a compaction method of the sloping ground using the roller wherein said pair of crawlers are attached to the body, and wherein a compaction is carried out while said vibratory roll is vibrating only perpendicularly to the ground.

DETAILED DESCRIPTION OF THE INVENTION

As one of the preferred embodiment of the present invention, a roller, which is designed as a vibratory roller in which vibratory roll is equipped in articulating manner, will be explained as follows.

Figure 1A:
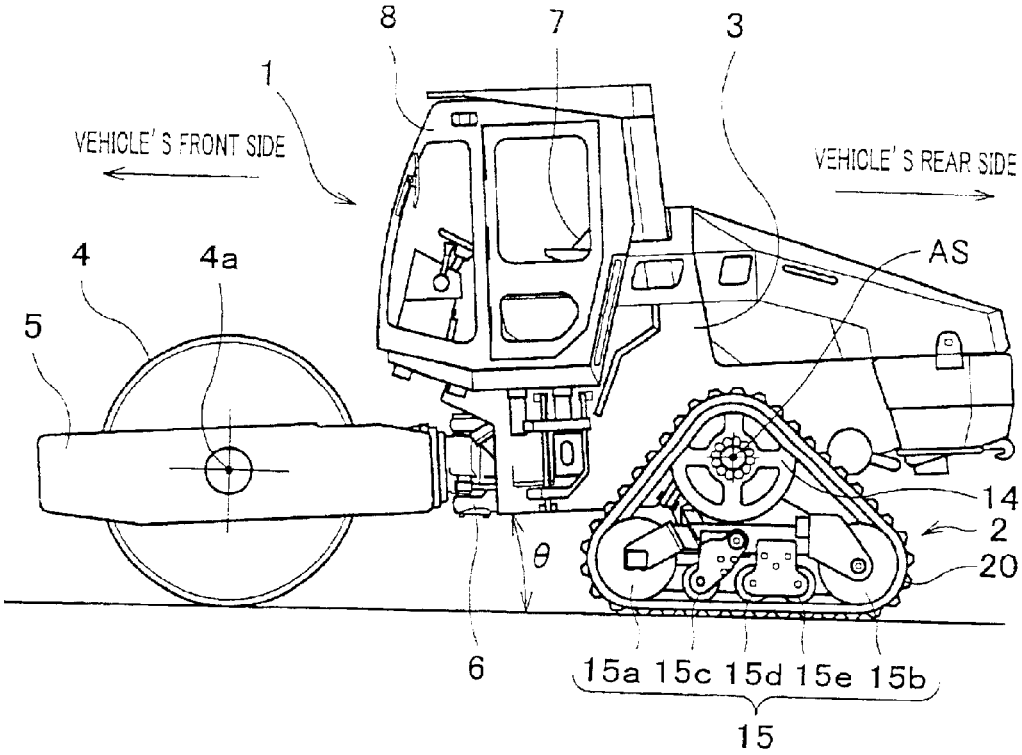
FIG. 1A is an explaining side view of a roller (vibratory roller) according to the present invention.
Figure 1B:
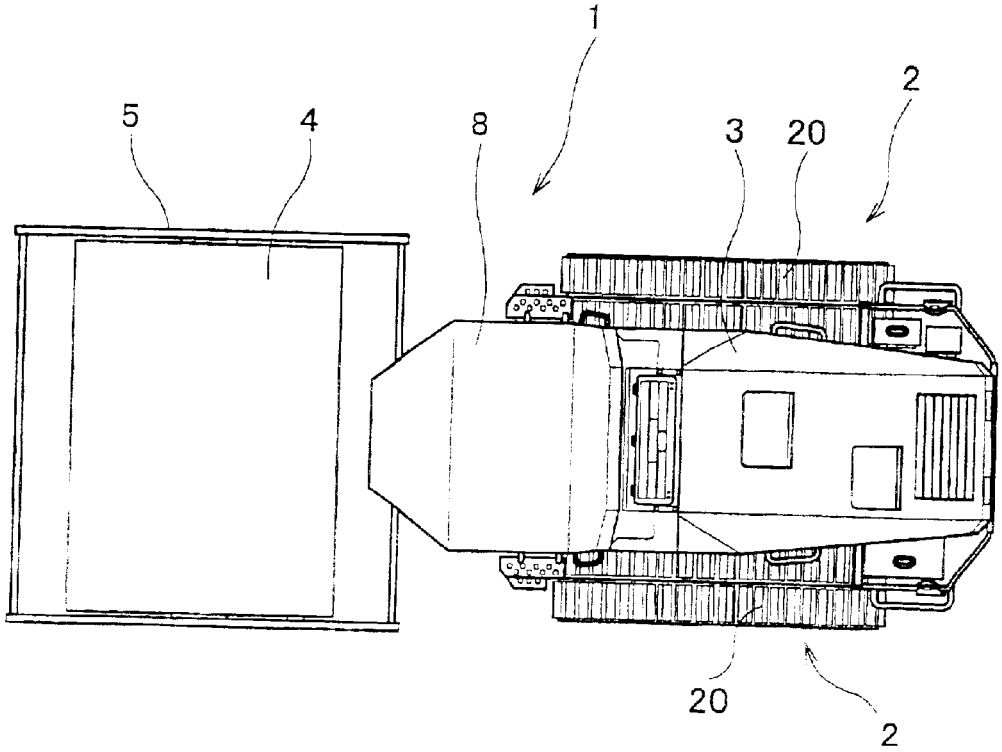
FIG. 1B is an explaining plan view of a roller (vibratory roller) according to the present invention.

As shown in FIG. 1, a vibratory roller 1 is composed of a vehicle body 3, on both sides of which crawlers 2 are equipped, and a machine frame 5, which has the casing shape in plan viewing. A roll 4 is rotatably supported between frame members, which face each other within the machine frame 5, and disposed at the front side of the vehicle body 3. The vehicle body 3 and the machine frame 5 are joined in articulating manner through a connecting part 6. A cab seat 7 is provided on the vehicle body 3. The model shown in drawing serves as the cabin specification vehicle with the cabin 8 surrounding the cab seat 7.

When the steering wheel in the cab seat 7 is operated, the vehicle body 3 and the machine frame 5 mutually turn in the left-and-right direction by the actuation of the oil hydraulic cylinder for steering (not shown). If the waviness (unevenness) and the like exists in the left-and-right direction of the road surface, the vehicle body 3 and the machine frame 5 tilt around the base axis of the front-and-rear directions along the waviness.

The vibrating equipment, which has the perpendicularly vibratory mechanism, and which will be explained later in detail, is installed within the roll 4. The compaction of the ground is carried out while vibrating the roll 4 by the actuation of the vibrating equipment through the ON operation of the switches arranged near the cab seat 7.

Figure 2:
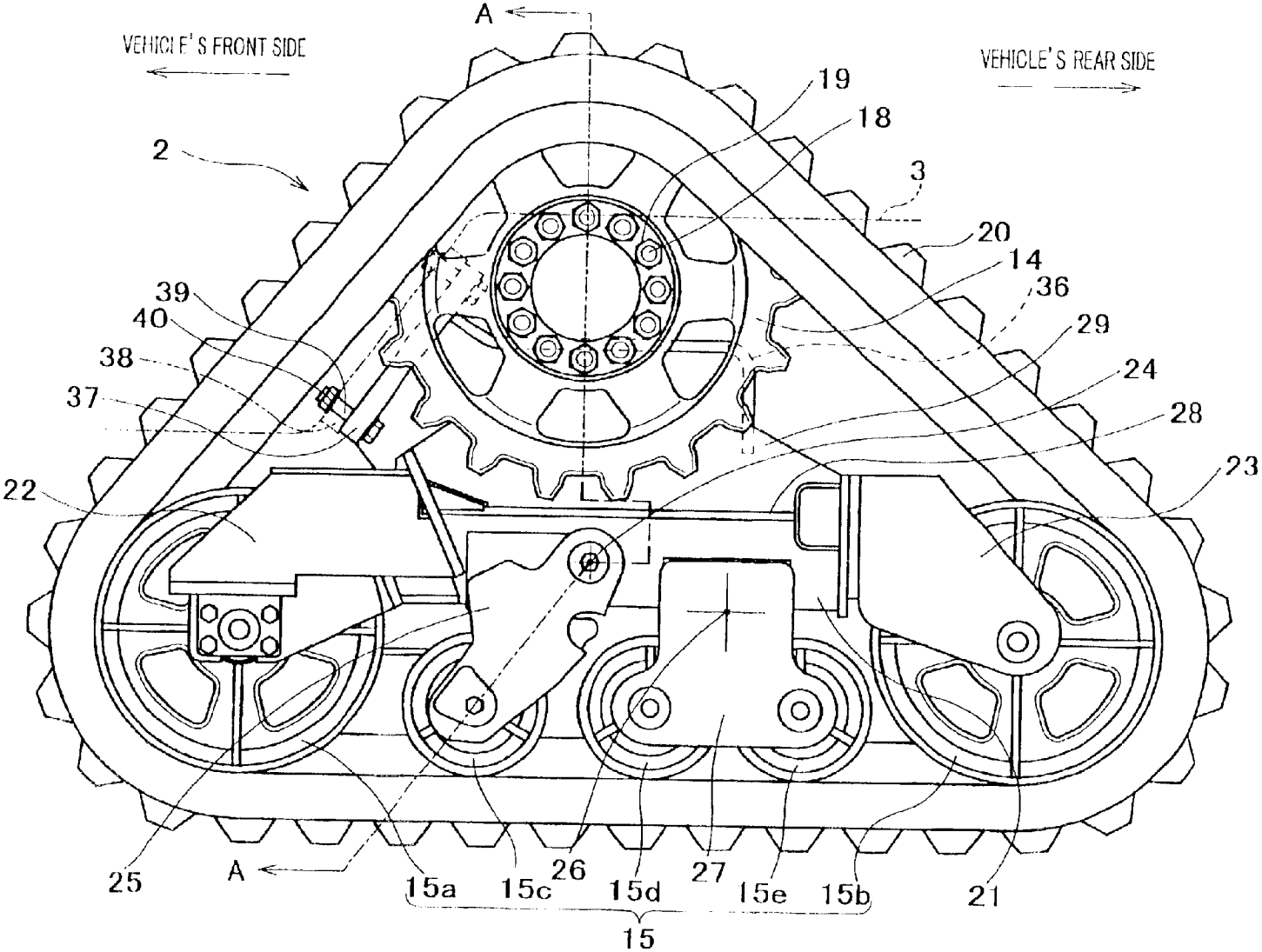
FIG. 2 is an explaining side view of the crawler located at the left side of the vehicle body.
Figure 3:
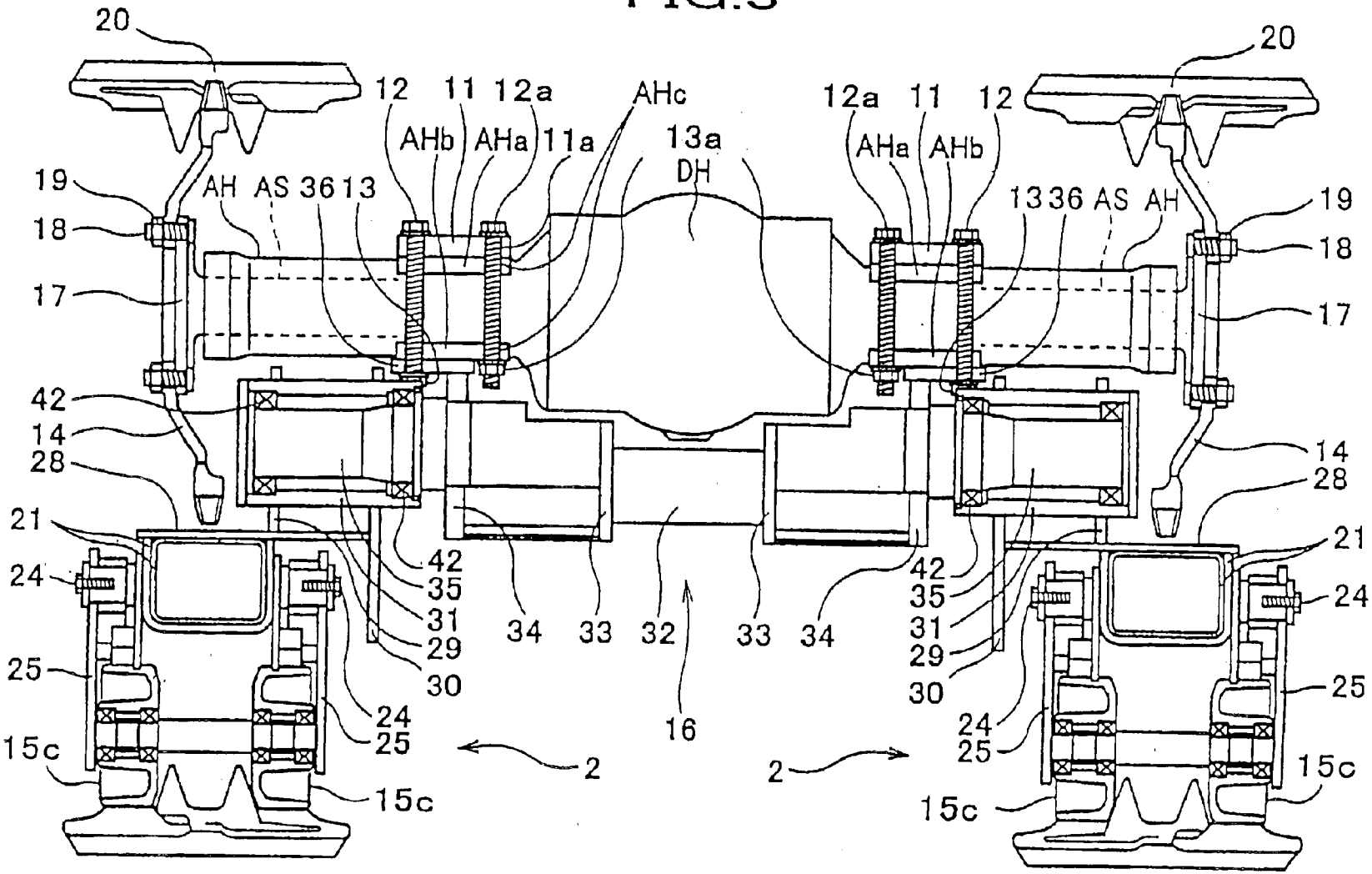
FIG. 3 is sectional view along the line A—A in FIG. 2.

A differential unit (a differential gear) (not shown) is disposed at the bottom part of the vehicle body 3. FIG. 2 is a side view of the crawler 2 located on the left side of the vehicle body 3. FIG. 3 is a sectional view along the line A—A in FIG. 2.

As shown in FIG. 3, a chassis of the differential unit is composed of a differential-housing DH, into which the differential gear (not shown) and the like are installed, and axle-shaft housings AH of the right-and-left couple, which prolong in the longitudinal direction and store the axle-shaft AS therein. The axle-shaft housings AH are integrally fixed at the both side ends of the differential-housing DH.

At the upper and lower part of each of the axle-shaft housing AH, an upper attachment plate AHa and a lower attachment plate AHb, which are prolonged toward the front-and-rear directions of the vehicle, are horizontally fixed so that the upper attachment plate AHa and the lower attachment plate AHb face each other.

At the upper attachment plate AHa and the lower attachment plate AHb, total of four through-holes AHc are provided respectively. Two of four through-holes AHc are provided in the rear-side direction of the vehicle with respect to the axle-shaft housing AH. The two remaining through-holes AHc are provided in the front-side direction of the vehicle with respect to the axle-shaft housing AH.

A symbol 11 indicates a frame plate, which constitutes the bottom part of the vehicle body 3. Through-holes 11*a* are bored to the frame-plate 11 at the position corresponding to the through-holes AHc of the upper attachment plate, so that the through-holes 11*a* and the through-holes AHc are in agreement when the upper attachment plate AHa is applied to the frame plate 11.

Therefore, when the bolt 12 is penetrated into the through-hole 11*a* and the through-hole AHc from the upper part of the frame plate 11, and screwing the nut 13 to the bolt 12 at the bottom surface of the lower attachment plate AHb on applying the upper attachment plate AHa to the frame plate 11, the differential-housing DH and the axle-shaft housing AH are fixed to the under part of the vehicle body 3.

In the present invention, each of the crawlers (the left-side crawler and the right-side crawler) is of the same construction. Thus, for convenience, the following explanation is directed to the left-side crawler 2. As shown in FIG. 3, the crawler 2 is characterized in that the driving wheel 14 is detachably attached to the driving shaft (axle-shaft AS), and the connecting member 16, which integrally supports the driven wheels 15 of the crawlers 2, is detachably attached to the bottom part of the vehicle body 3 (also see FIG. 4, FIG. 5, and FIG. 6). The driven wheels 15 of both the left-side crawler and the right-side crawler are supported by the single connecting member 16.

Figure 4:
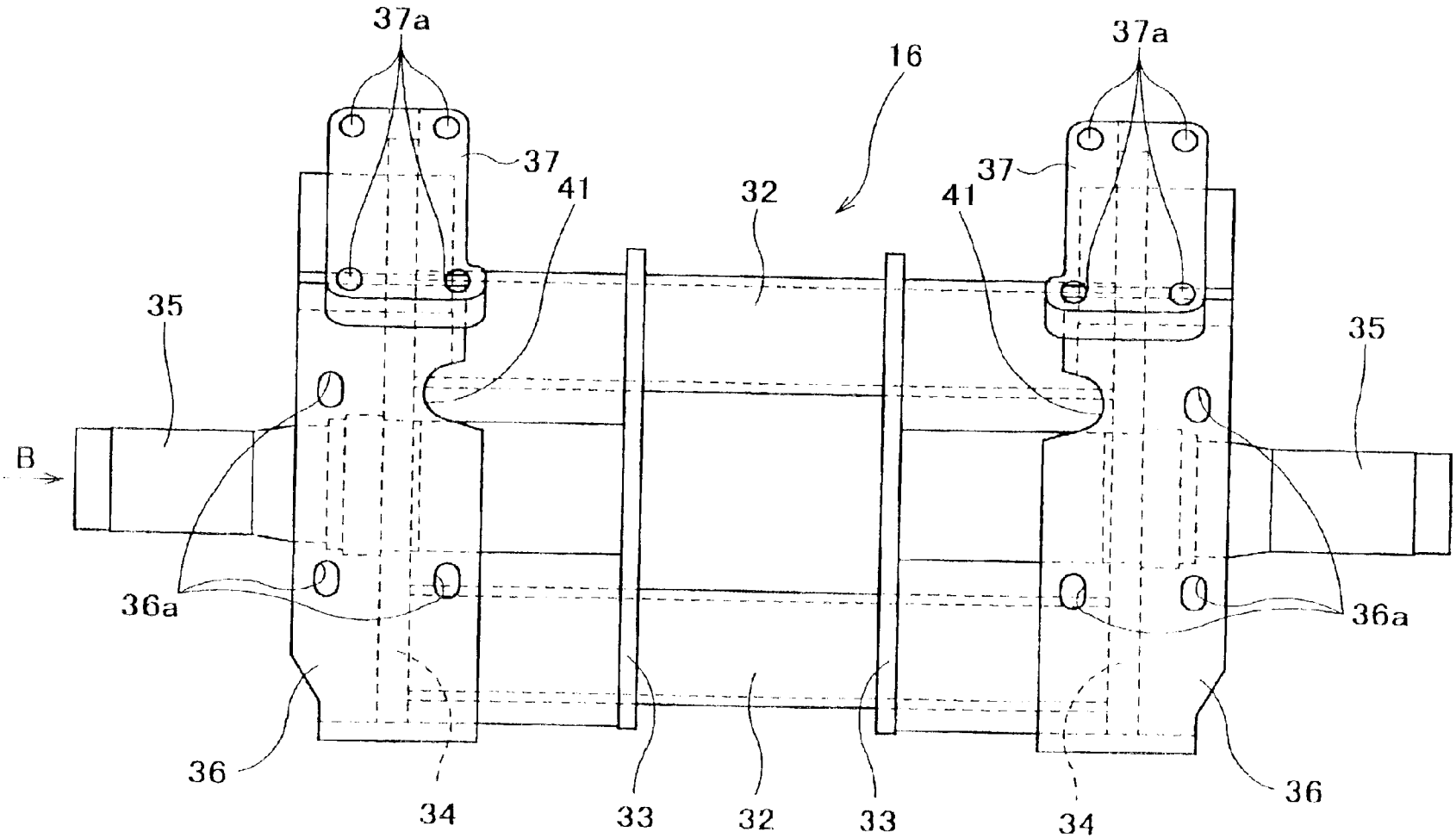
FIG. 4 is an explaining plan view of a connecting member 16.
Figure 5:
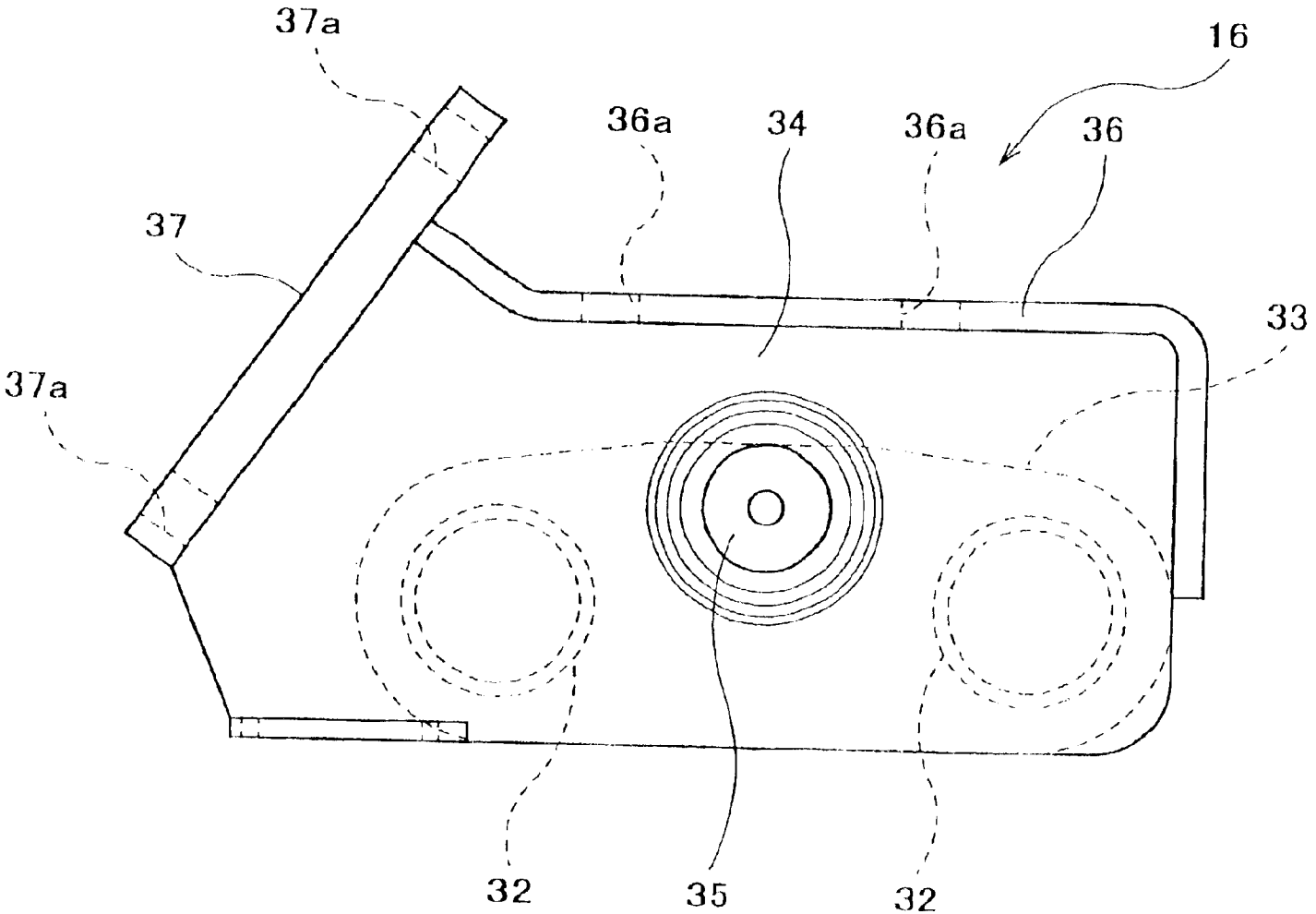
FIG. 5 is a plan view looked from the arrowhead B-side in FIG. 4.
Figure 6:
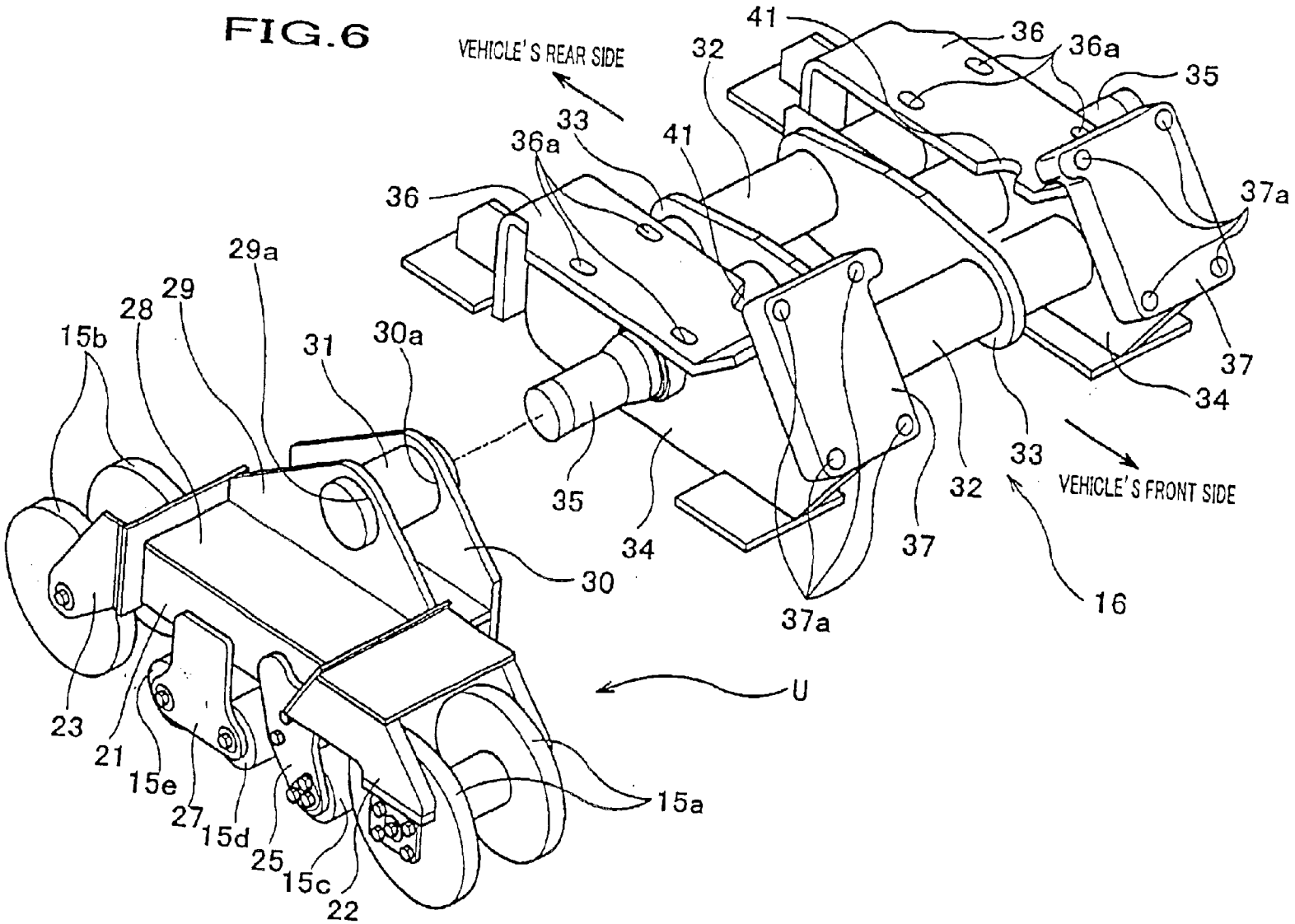
FIG. 6 is a schematic perspective view of a connecting member.

FIG. 4 is a plan view of the connecting member 16. FIG. 5 is a plan view looked from the arrowhead B-side in FIG. 4. FIG. 6 is a schematic perspective view of the connecting member 16.

As shown in FIG. 3, a hub 17 is attached to respective side ends of the axle-shafts AS. Thus, the driving wheel 14 is detachably attached to the hub 17 using hub bolts 18 and the hub nuts 19. In the present preferred embodiment, as can be seen in FIG. 2, a crawler track 20 is put around the driving wheel 14 and the series of driven wheels 15 so that the profile of the crawler track 20 has a triangle shape in the side viewing on the condition that the driving wheel 14 is arranged at the top-most-vertices side.

In the present preferred embodiment, furthermore, a rubber crawler is used as the crawler 2, in which the crawler track 20 is made of a rubber material. As shown in FIG. 2, the driven wheel 15 is composed of a front-side driven wheel 15*a*, a rear-side driven wheel 15*b*, and a guide rolls 15*c*, 15*d*, and 15*e*. The front-side driven wheel 15*a* and rear-side driven wheel 15*b* have large diameter and are arranged at the front end and the rear end, respectively. The guide rolls 15*c*, 15*d* and 15*e* have a small diameter and are arranged between the front-side driven wheel 15*a* and rear-side driven wheel 15*b*.

As shown in FIG. 2 or FIG. 6, the front-side driven wheel 15*a* and the rear-side driven wheel 15*b* are rotatably supported at a front part bracket 22 and a rear part bracket 23, respectively. The front part bracket 22 and the rear part bracket 23 are fixed to the frame 21 for the driven wheel which is prolonged in the front-and-rear directions of the vehicle.

The guide roll 15*c* is rotatably supported by a bracket 25, which is attached to the frame 21 so that it can pivot on a basis shaft 24. The guide roll 15*d* and 15*e* are rotatably supported by a bracket 27. The bracket 27 is attached to the frame 21 so that it can pivot on a basis shaft 26 and it can move in the vertical direction.

As shown in FIG. 3 and FIG. 6, a bracket 28 is horizontally fixed to the upper part of the frame 21 for the driven wheels. Vertical bracket 29 and 30 are vertically fixed to the bracket 28 so that the vertical brackets 29 and 30 become parallel with each other.

As shown in FIG. 6, a through-hole 29*a* and 30*a* are bored through the vertical brackets 29 and 30, respectively. The cylindrical cylinder-shaped member 31 is fixed by the welding and the like in the condition of having been inserted in the through-holes 29*a* and 30*a*. Hereinafter, a sub assembly, which is composed of the frame 21, the driven wheels 15, the bracket 28, the vertical brackets 29 and 30, and the cylinder-shaped member 31, is defined as a driven wheel unit U.

Referring to FIG. 3 through FIG. 6, the explanation about the connecting member 16 will be carried out. The connecting member 16 has beam members 32 that extend along the width direction of the vehicle body.

In the present preferred embodiment, the beam member 32 is made of a steel pipe. Each end of the beam member 32 is connected to an inner connecting plate 33 and an outer connecting plate 34. The beam member 32 is united with the inner connecting plates 33 and the outer connecting plates 34 into an integral body.

At the outer surface side of each of the outer connecting plates 34, an axis member 35 is provided- The axis members 35, which are prolonged in the longitudinal direction from the outer connecting plates 34, are coaxially arranged.

As shown in FIG. 3, the cylinder-shaped member 31 is rotatably attached to the axis member 35 through a bearing 42. As can be seen in FIG. 6, since the driven wheel unit U is pivotally attached to the connecting member 16, each of the driven wheels 15 of the crawler 2 are integrally supported by the connecting member 16.

A first attaching plate 36 is horizontally fixed to the upper part of the outer connecting plate 34. A second attaching plate 37 is slantingly fixed on the front-side of the first attaching plate 36.

As shown in FIG. 4, a plurality of through-holes 37*a* are bored to the second attaching plate 37 (in this embodiment, there are four through-holes 37*a*). As shown in FIG. 2, the second attaching plate 37 is fixed to a frame plate 38, which is slantingly fixed to the bottom part of the vehicle body 3, by fastening the bolt 39 to the nut 40 on applying the second attaching plate 37 to the frame plate 38.

In the present embodiment, furthermore, the attachment of the first attaching plate 36 to the vehicle body 3 is carried out using the bolt 12 and the nut 13 which are used for fixing the axle-shaft housing AH and the differential-housing DH to the vehicle body 3 (FIG. 3).

In other word, the connecting member 16 and the axle-shaft housing AH are attached to the vehicle body 3 by fastening together. As shown in FIG. 4, FIG. 6, and other Figures, a plurality of through-holes 36*a* are bored to the first attaching plate 36. As shown in FIG. 3, the first attaching plate 36 is detachably tightened and fixed to the bottom part of the axle-shaft housing AH by fastening the bolt 12 to the nut 13 in the condition that the first attaching plate 36 is applying to the lower attachment plate AHb.

If it is designed so that the first attaching plate 36 is tightened and fixed to the axle-shaft housing AH by using all of the bolt 12 and the nut 13, when the bolt 12 and the nut 13 are removed for detaching the connecting member 16 from the vehicle body 3 in the case of the maintenance or the replacement, for example, the axle-shaft housing AH and the differential housing DH are simultaneously detached from the vehicle body 3. Thus the operation will be troublesome.

For resolving these disadvantages, a notching part 41 with a suitable size for enabling the screwing operation of the boll 12 to the nut 13 without interference is provided to the first attaching plate 36 as shown in FIG. 4 and FIG. 6. At the notching part 41, only the axle-shaft housing AH and the differential housing DH are tightened and fixed to the vehicle body 3 by the bolt 12*a* and the nut 13*a* (in the FIG. 3, for easily recognize, symbols 12*a* and 13*a* are used instead of symbol 12 and 13 for indicating the bolt and the nut, which are located at the notching part 41, respectively).

On the other hand, at the through-holes 36*a*, the first attaching plate 36 is tightened and fixed to the vehicle body together. In other words, the connecting member 16 and the axle-shaft housing AH are tightened and fixed to the vehicle body 3 together at the position of the through-hole 36*a*.

According to this construction, the axle-shaft housing AH and the differential-housing DH will be in the tightened and fixed condition to the vehicle body 3 by the bolt 12*a* and the nut 13*a* even if the connecting member 16 is detached from the vehicle body 3 by unscrewing the bolt 12 from the nut 13. As for this construction, a through-hole may be acceptable instead of the notching 41 as long as it has a suitable diameter for enabling the screwing operation of the bolt 12 to the nut 13 without interference.

As described above, the driving wheels 14 are detachably attached to the driving shaft (axle-shaft AS), and the connecting member 16, which supports the driven wheels 15 of the crawlers 2, is detachably attached to the bottom part of the vehicle body 3. Thus, the detaching operation of the crawlers 2 from the vehicle body 3, which is carried out in the case of the repairing and the replacing, for example, will be achieved with ease as compared to conventional structures.

Figure 7:
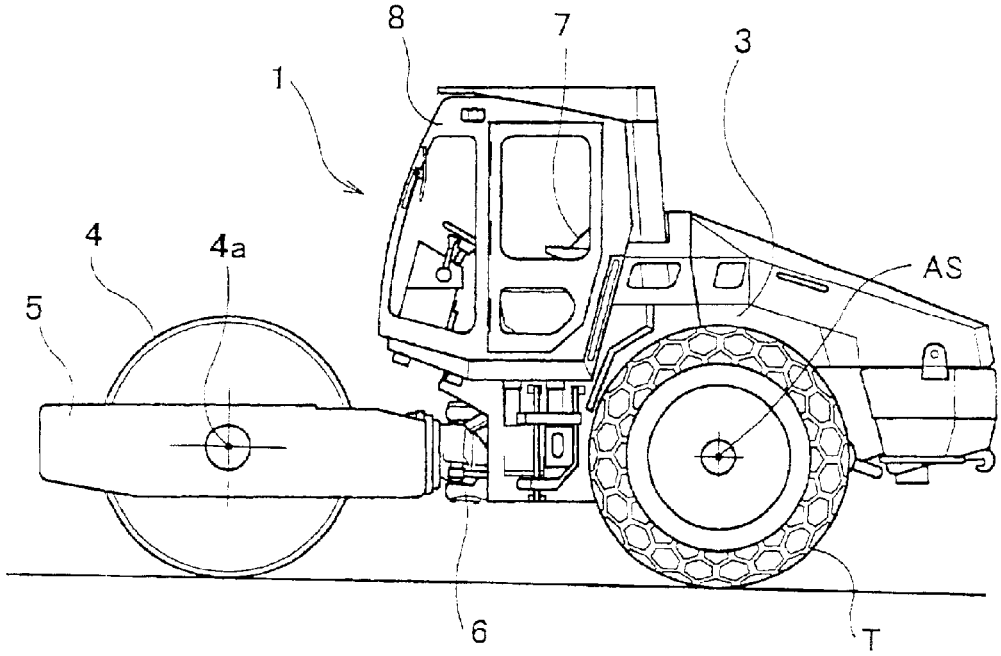
FIG. 7 is an explaining side view of a vibratory roller in which tire is equipped instead of the crawler.

As shown in FIG. 7, when the roller is designed so that the crawler is replaceable with a tire T and the tire is also detachably attached to the driving shaft (axle-shaft AS), it is useful because the replacing operation between the tire T and the crawler 2 can be easily carried out in the construction site depending on the operating situation.

When detaching the crawler 2 for replacing with the tire T, the detaching operation is achieved with ease only by removing the driving wheel 14 and the connecting member 16 from the axle-shaft AS and the bottom part of the vehicle body 3, respectively. In this case, the connecting member 16 is removed by unscrewing the bolt 12 from the nut 13 (FIG. 3) and the bolt 39 from the nut 40 (FIG. 2).

The Detailed drawing at the time of equipping an axle shaft AS with Tire T is omitted. When attaching the tire T, the tire T is tightened and fixed to the hub 17 using the hub bolt 18 and hub nut as it is, which were used for attaching the driving wheel 14.

The vibratory roller is used in the compaction of the embankment by which the traveling motion tends to be unstable by the irregularity, and also used to the compaction of the asphalt pavement by which the traveling motion is stabilized. Thus, the vibratory roller in which the tire T and the crawler 2 were provided as replaceable is fully useful.

Suitable use of the tire T and the crawler 2 is different. For example, when the vibratory roller is used in the usual compaction such as in the flat grounds, the tire T is attached. On the other hand, when the vibratory roller is used in the compaction of the sloping ground (slope) or the muddy road after rainfall, the crawler 2 is attached so that the ground pressure is dispersed uniformly and the anti-slipping performance is demonstrated.

In the construction site, such as a highway or a dam, the compaction tends to be carried out in the steep sloping ground of more than 20-degree in sloping angle. Thus, if the operation is continued in the condition that the vehicle body 3 is being inclined greatly along this inclined plane, the operator tends to give the mental pressure himself.

Under these conditions, furthermore, since the cab seat 7 is also inclined along with the inclination of the vehicle body 3, operator is exposed to the condition of being inclined to the upper or the lower. When the operation is continued in the inclined condition for a long time, the tiredness of operator may increase as compared to the compaction in the level ground.

In the present embodiment, as can be seen from FIG. 1A, the vehicle body 3 is inclined with respect to the level surface by locating the driving shaft AS, to which the driving wheel 14 of the crawler 2 is attached, above the rotating shaft 4*a* of the roll 4.

In FIG. 1A, the vibratory roller 1, the front direction of which is inclined to downward with respect to the level tread having a inclined angle θ, is shown. In this vibratory roller 1, it is designed so that the vehicle body 3 may be in the level condition to the tread, when the tire T is attached for the compaction in the level ground.

Figure 8:
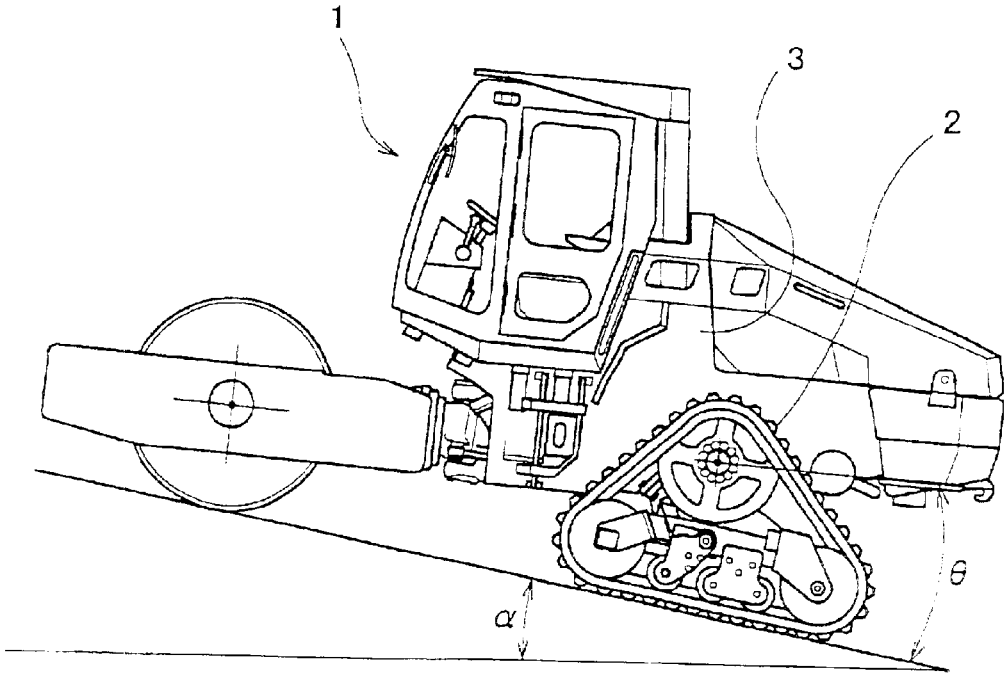
FIG. 8 is an explaining side view of a compaction of the sloping ground using a vibratory roller equipped with the crawler.

When the compaction using the crawler 2 is carried out in the sloping ground of degree α in sloping angle (conventionally, compaction in the sloping ground is carried out on locating the roll 4 in the upward direction), in the case of the conventional vibratory roller, the vehicle body 3 is inclined at same degree as the sloping angle of the sloping ground. On the other hand, as shown in FIG. 8, according to the present invention, since the vehicle body 3 is inclined at the degree (α-θ), which is obtained by deducting the inclination degree θ of the vehicle body 3, the degree of the mental pressure caused by the inclination of the vehicle body 3 will be decreased. The inclination of the cab seat 7 is also decreased by degree θ as compared to the conventional, thus the fatigue degree of the operator is also decreased.

A perpendicularly vibratory mechanism 112, which vibrates the roll 4 only in the perpendicular direction to the ground surface, is installed within the roll 4. FIG. 9 is a schematic block diagram view showing an example of the perpendicular vibrator mechanism 112.

Vibrating shafts 113A and 113B are installed within the roll 4 at the same height location from the ground so that it may become parallel mutually along the longitudinal (the front-and-back direction in FIG. 9) of the roll 4 with the well-known manner. The vibrating shaft 113A and 113B are supported within the roll 4 so that they can synchronously rotate in the reverse direction mutually, and the eccentric weight 114A and 114B are attached thereto.

Figure 9A:
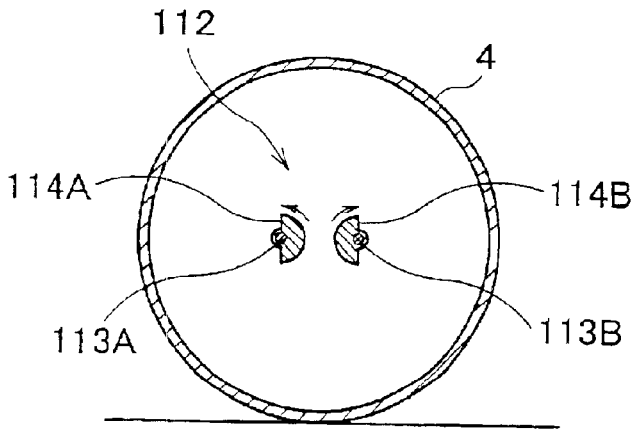
FIGS. 9A through 9D are explanatory views for explaining the function of the perpendicularly vibratory mechanism.

The mutual relation and the eccentrically location of the eccentric weight 114A and 114B will be explained. As shown in FIG. 9A, the eccentric weight 114A and 114B are fixed to the vibrating shaft 113A and 113B, respectively, so that the eccentric weight 114A and 114B have the phase difference of 180-degrees when the eccentric weight 114A and 114B are made into the level condition.

Figure 9B:
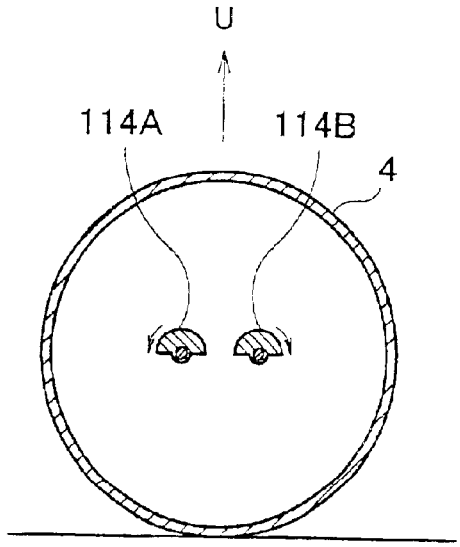

Therefore, since the vibrating shaft 113A and 113B are synchronously rotate in the reverse direction mutually, the eccentric weight 114A and 114B are located upward together in the case of FIG. 9B. Thus, the vibrating force, which affects in the symbol U direction (upper direction), is applied to the tread of the roll 4. On the other hand, the eccentric weight 114A and 114B are located downward together in the case of FIG. 9D. Thus, the vibration force, which affects in the symbol D direction (lower direction), is applied to the tread of the roll 4.

Figure 9C:
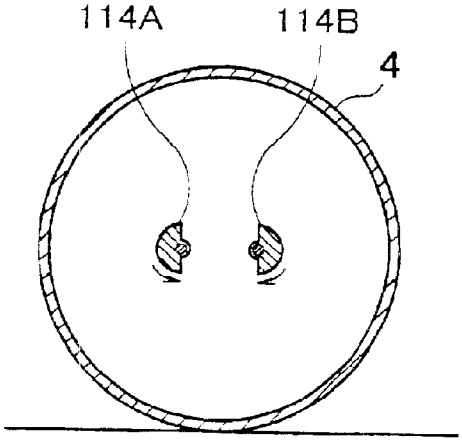
Figure 9D:
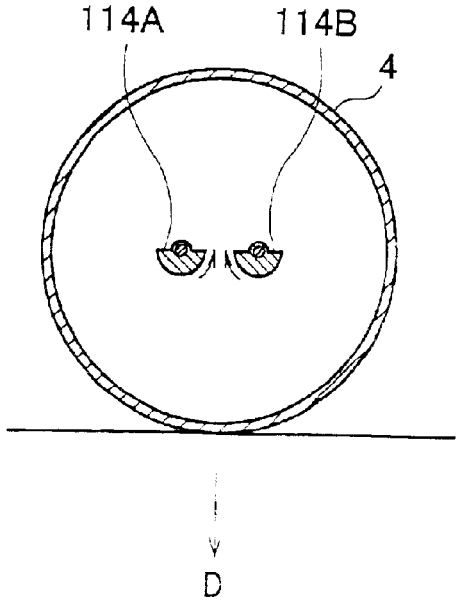

In the case of FIG. 9A and FIG. 9*c*, since the eccentric weights 114A and 114B are located in the opposite phase, a centrifugal force thereof is offset mutually, and thus the vibration force is not brought to the roll 4. As shown in FIG. 9, the phase of the eccentric weight 114A and 114B are in agreement only when the eccentric weight 114A and 114B are located in the directly above or directly below direction. Thus, when the phase of the eccentric weight 114A and 114B are in agreement, since the centrifugal force of them are combined, the roll 4 is vibrated only in the perpendicular direction (the direction perpendicular to the ground surface).

Figure 11A:
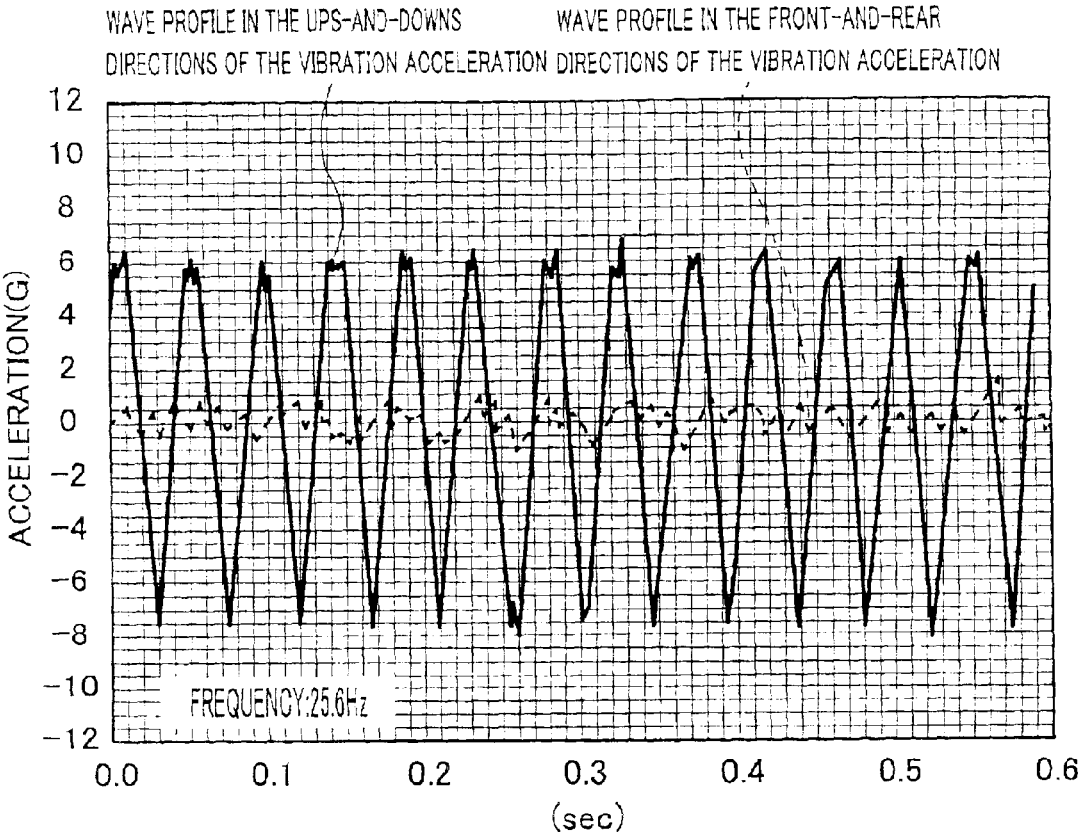
FIGS. 11A and 11B are graphs showing the wave profile in the ups-and-downs and front-and-rear directions and the wave composite of the vibration acceleration, which is applied to the roll by the perpendicularly vibratory mechanism.
Figure 11B:
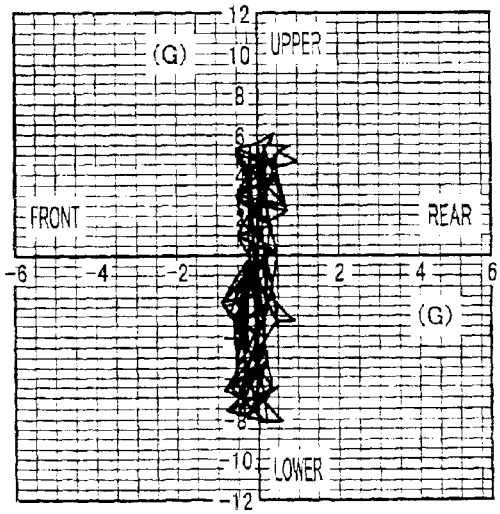
Figure 12:
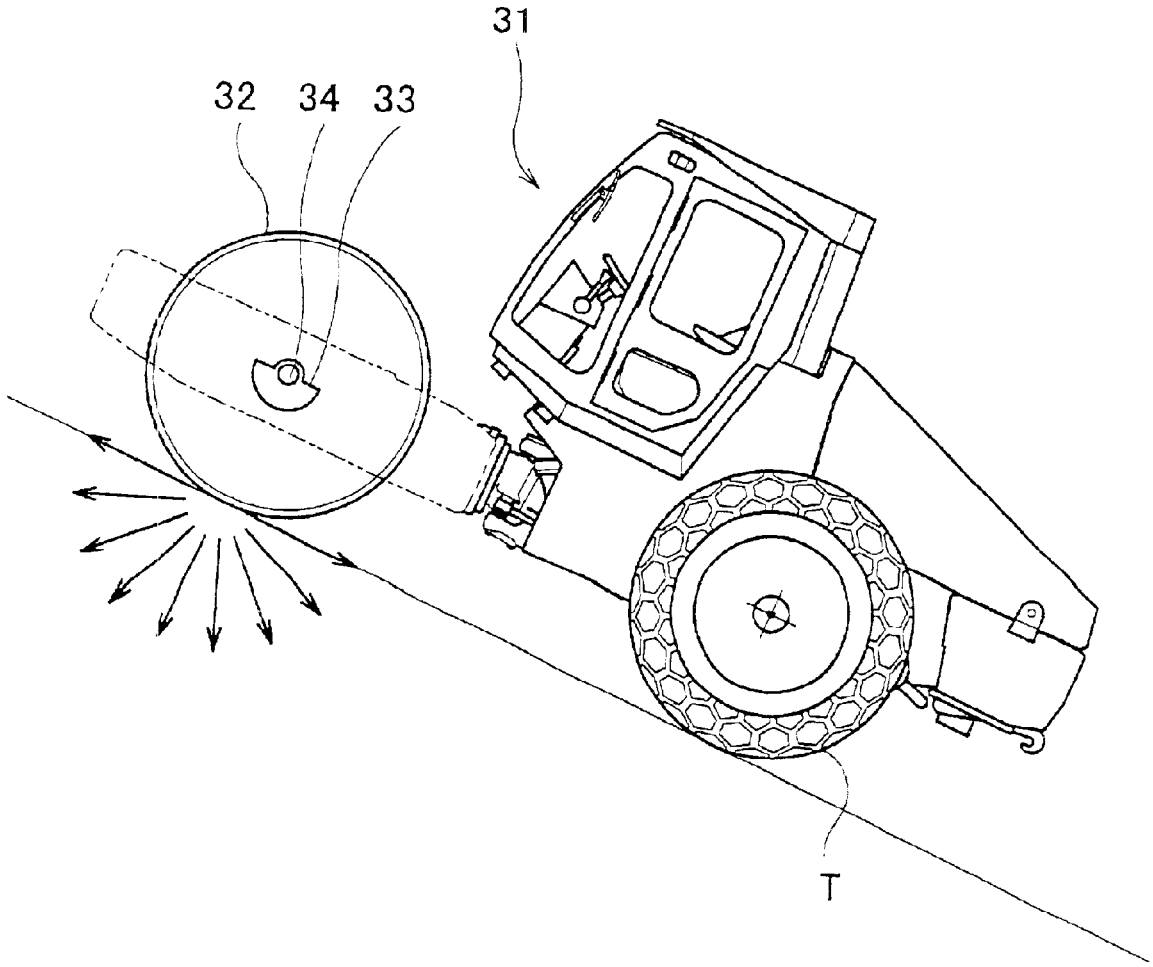
FIG.12 PRIOR ART
FIG. 12 is an explaining view of a conventional method of the compaction.
Figure 13A:
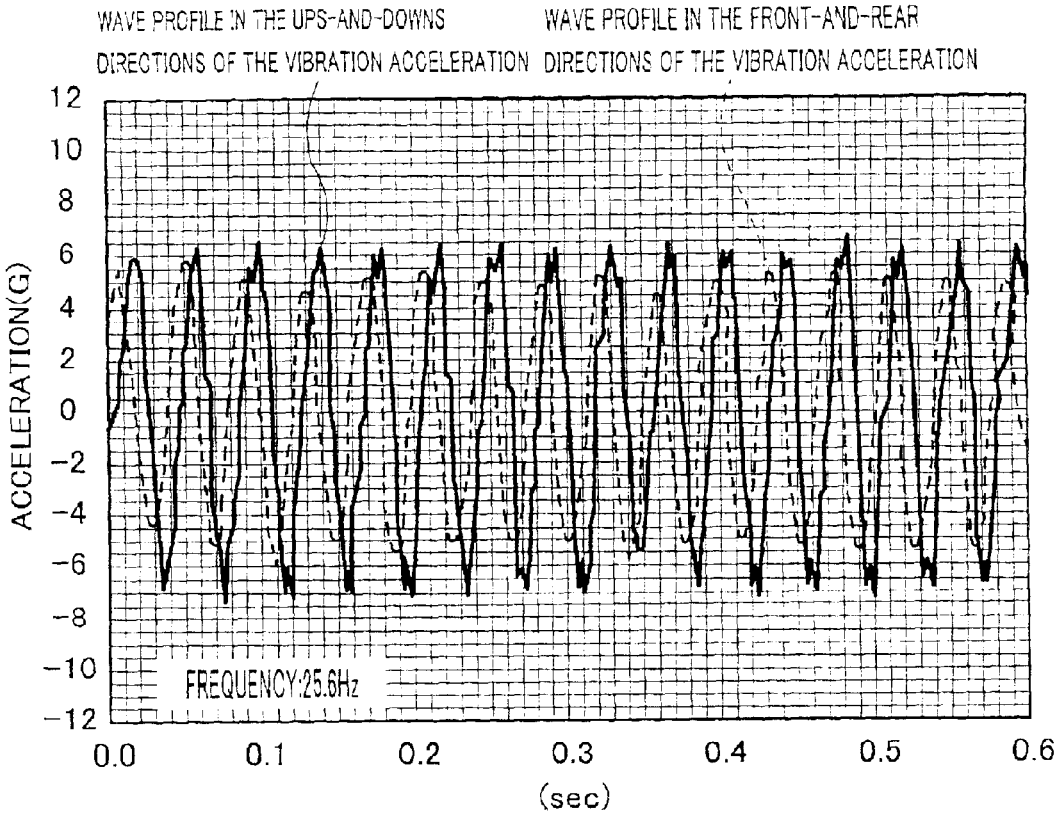
FIG.13A PRIOR ART
FIGS. 13A and 13B are graphs showing a wave profile in the ups-and-downs and front-and-rear directions and the wave composite of the vibration acceleration, which is applied to the roll by the conventional perpendicularly vibratory mechanism.
Figure 13B:
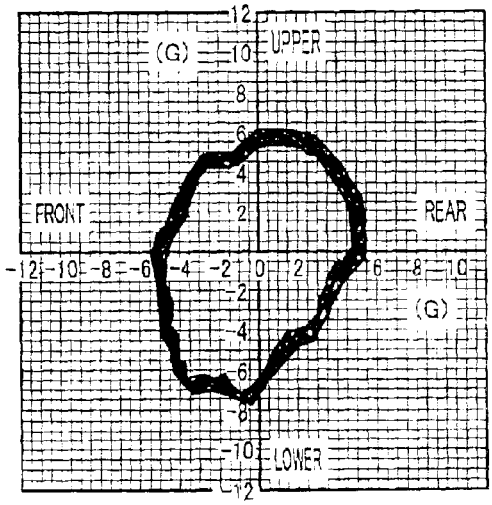
FIG.13B PRIOR ART

FIG. 11A is a graph showing the wave profile in the ups-and-downs and front-and-rear directions of the vibration acceleration, which is applied to the roll 4 by the perpendicular vibrator mechanism 112. FIG. 11B is a graph showing the wave composite of the vibration acceleration. As can be seen in FIG. 11B, the wave composite of the vibration acceleration is displacing along the locus of only in the ups-and-down direction with respect to the ground on regarding the shaft center of the roll 4 as center. Thus the compaction of the ground can be carried out under the stabilized condition, and also superior operationablity of sterling wheel can be accomplished.

When the compaction of the sloping ground is carried out using the vibratory roller 1, equipped with the roll 4 explained above, while climbing the sloping ground, that is, when the compaction is carried out along the manner where the compaction is carried out by vibrating the roll only in the perpendicular direction with respect to the ground surface of the sloping ground while driving the vibratory roller 1 using the crawler, the following effects will be given.

Figure 10:
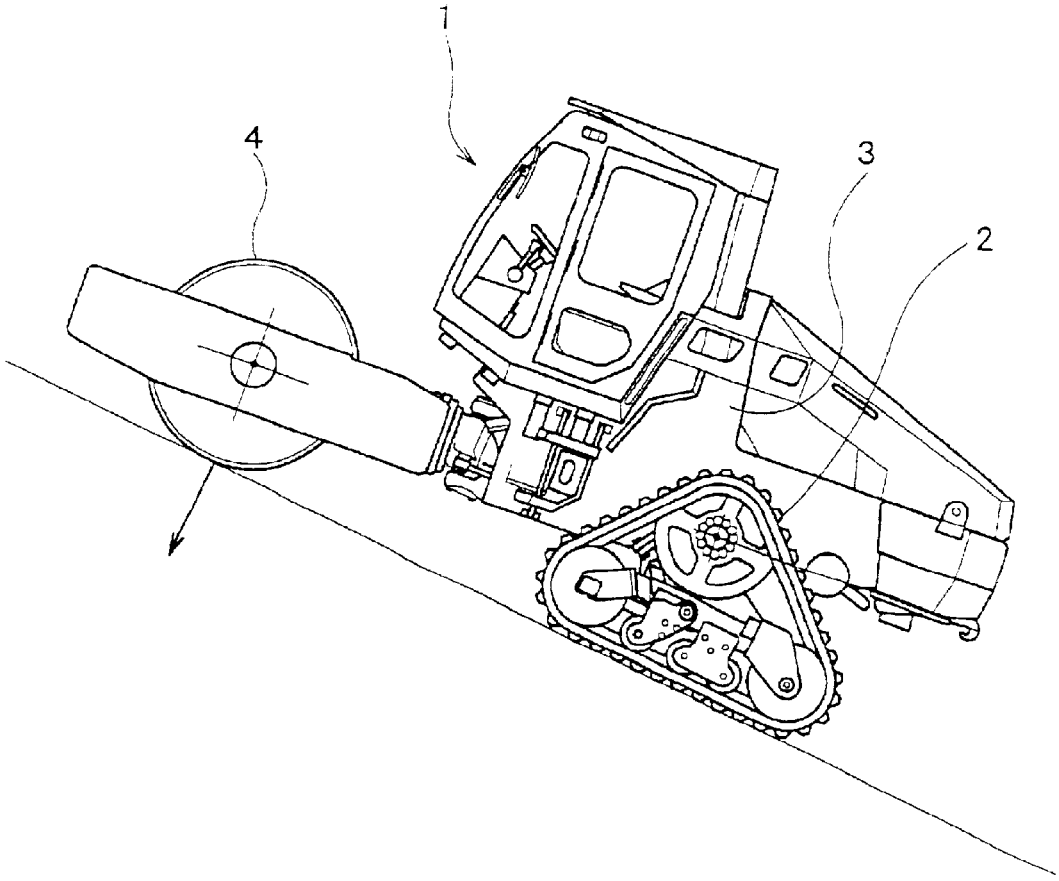
FIG. 10 is an explaining view of the function of a method of the compaction according to the present invention.

As shown in FIG. 10, since the reaction force applied to the roll 4 from the ground is only in the perpendicular direction with respect to the ground, the reaction force of the front-and-rear directions to the vehicle body 3 is decreased as compared to the conventional. Thus, the shaky movement of the vehicle body 3 is decreased, and the keeping of the attitude of the vehicle body 3 into stabilized condition can be achieved.

Therefore, getting off of the balance of the vehicle body 3 and the difficulty of the steering operation of the sterling handle, which is caused by the amplification of the gravity with the unbalance of the vehicle body 3, are not arisen even in the steep sloping ground of more than 20-degree. The problem that the keeping of the attitude of the vehicle body 3 becomes difficult is settled.

Also, since the vibratory roller 1 drives using the crawler 2, the superior trafficability (the ability of the running the whole distance) as compared to the vibratory roller equipped with the tire T and suitable keeping of the rectilinearity in the steep sloping ground are given. Thus, stability of the vehicle body 3 is also improved, and then the feeling of insecurity caused by the unstableness of the vehicle body 3 on the steep sloping ground is relieved.

According to the present invention, the following effectiveness will be given.

1) According to the roller, in which a pair of driving wheels attached on both sides of a driving shaft of the crawlers, each of said driving wheels being detachable from the driving shaft; a set of right-and-left driven wheels for the crawlers arranged on both sides of the (vehicle) body; and a connecting member integrally supporting the set of right-and-left driven wheels, said connecting member is attached on a bottom of the (vehicle) body and is detachable from the (vehicle) body with the set of driven wheels attached thereto, the detaching operation of the crawler from the vehicle body will be achieved with ease as compared to the conventional.

2) According to the roller, in which the crawlers are replaceable with a pair of tires, and each of said tires being detachable from the driving shaft, when the selection between the tire and the crawler is carried out depends on the condition of the ground to be compacted, the traveling performance will be fully demonstrated. Since the compaction is achieved via only one vehicle (i.e., without requiring a plurality of the vehicles), the roller exceeds in economical efficiency.

3) According to the roller, in which a vibratory roll is connected to the (vehicle) body in an articulating manner, and wherein said driving shaft positions above a rotating shaft of the vibratory roll so that the (vehicle) body inclines with respect to the horizontal plane, the degree of the inclination of the vehicle body on the sloping ground in the case of the compacting execution will be smaller. Since the degree of the inclination angle of the vehicle can be smaller, the degree of the mental pressure, which is given to the operator himself by the inclination of the vehicle body, is alleviated.

According to the roller and the compaction method of the sloping ground using the vibratory roller, since stability of the vehicle body 3 is also improved, and then the feeling of insecurity caused by the unstableness of the vehicle body 3 on the steep sloping ground is relieved.

What is claimed is:

1. A roller comprising:

a body;

a driving shaft, which has a left-side end and right-side end, mounted to the body for rotation on the body, wherein said driving shaft is attached to the body with connection bolts;

a single connecting member detachably attached to a bottom of the body with at least one of said connection bolts that attaches said driving shaft to said body;

a left-side crawler mounted on a left side of the body; and a right-side crawler mounted on a right side of the body;

wherein each of the left-side crawler and the right-side crawler includes a driving wheel and a set of driven wheels, the driving wheel of the left-side crawler being detachably attached to the left-side end of the driving shaft, and the driving wheel of the right-side crawler being detachably attached to the right-side end of the driving shaft; and wherein the set of driven wheels of the left-side crawler and the set of driven wheels of the right-side crawler are attached to the bottom of the body through the same single connecting member.

2. A roller according to claim 1, wherein each of the left-side crawler and the right-side crawler is replaceable with a tire.

3. A roller according to claim 1, wherein the roller is a vibratory roller, which includes a vibratory roll connected to the body in an articulating manner, and wherein the driving shaft is positioned above a rotating shaft of the vibratory roll so that the body inclines with respect to the horizontal plane.

4. A roller according to claim 2, wherein the roller is a vibratory roller, which includes a vibratory roll connected to the body in an articulating manner, and wherein the driving shaft is positioned above a rotating shaft of the vibratory roll so that the body inclines with respect to the horizontal plane.

5. A roller according to claim 1, further comprising a roll having a perpendicularly vibratory mechanism, which vibrates the roll only in the perpendicular direction with respect to the ground surface.

6. A roller according to claim 2, further comprising roll having a perpendicularly vibratory mechanism, which vibrates the roll only in the perpendicular direction with respect to the ground surface.

7. A roller according to claim 1, wherein the single connecting member has connection which is provided with a plurality of holes and is used for attaching the single connecting member to the bottom of the body using connection bolts being inserted into holes.

8. A roller according to claim 7, wherein each connection plate has a notched part which prevents the contact between the connection plate and the connection bolt.

* * * * *